US012590707B2

(12) United States Patent
Bianchi et al.

(10) Patent No.: US 12,590,707 B2
(45) Date of Patent: Mar. 31, 2026

(54) SYSTEM AND METHOD FOR IMPROVED CONVECTION AIRFLOW IN A COOKING APPLIANCE

(71) Applicant: WHIRLPOOL CORPORATION, Benton Harbor, MI (US)

(72) Inventors: Fabio Bianchi, Cassinetta di Biandronno (IT); Ankur Garg, Maharashtra (IN); Dhiraj Jambuvant Gotekar, Maharashtra (IN); Satyabrata Dalai, Odisha (IN)

(73) Assignee: Whirlpool Corporation, Benton Harbor, MI (US)

( * ) Notice: Subject to any disclaimer, the term of this patent is extended or adjusted under 35 U.S.C. 154(b) by 970 days.

(21) Appl. No.: 17/591,225

(22) Filed: Feb. 2, 2022

(65) Prior Publication Data

US 2023/0243519 A1 Aug. 3, 2023

(51) Int. Cl.
*F24C 15/32* (2006.01)

(52) U.S. Cl.
CPC ..... *F24C 15/322* (2013.01)

(58) Field of Classification Search
CPC ..... F24C 15/322; A21B 1/26
USPC ..... 126/21 A, 21 R
See application file for complete search history.

(56) References Cited

U.S. PATENT DOCUMENTS

| | | | | |
|---|---|---|---|---|
| 7,411,160 | B2 | 8/2008 | Duncan et al. | |
| 8,258,435 | B2 | 9/2012 | Bonuso et al. | |
| 10,288,311 | B2 | 5/2019 | Cho et al. | |
| 2007/0095813 | A1 | 5/2007 | Sung et al. | |
| 2010/0147825 | A1* | 6/2010 | Bonuso | F24C 15/325 219/400 |
| 2020/0072475 | A1 | 3/2020 | Crow et al. | |

FOREIGN PATENT DOCUMENTS

| | | | |
|---|---|---|---|
| CN | 112244660 | A | 1/2021 |
| EP | 2060854 | A1 | 5/2009 |
| WO | 2008105581 | A1 | 9/2008 |

* cited by examiner

*Primary Examiner* — Vivek K Shirsat
(74) *Attorney, Agent, or Firm* — Price Heneveld LLP

(57) ABSTRACT

An oven air circulation apparatus includes a first fan coupled to at least one motor that rotates about a first rotational axis in a first direction and a second fan that rotates about a second rotational axis in a second direction, opposite the first direction. A baffle wall is disposed proximate to the first fan and the second fan forming a planar surface arranged substantially perpendicular to the rotational axes of the fans. A plurality of first openings formed in the baffle wall are aligned with the first fan. A plurality of second openings are formed in the baffle wall aligned with the second fan. The first and second openings successively increase in proportion radially outward from the first and second axes, respectively.

13 Claims, 7 Drawing Sheets

SYSTEM AND METHOD FOR IMPROVED CONVECTION AIRFLOW IN A COOKING APPLIANCE

TECHNOLOGICAL FIELD

The present disclosure generally relates to an air circulation apparatus for a cooking appliance. In particular, the air circulation apparatus provides for a ventilation configuration of the air circulation apparatus.

SUMMARY OF THE DISCLOSURE

According to one aspect of the present disclosure, an oven air circulation apparatus comprises a first fan coupled to at least one motor that rotates about a first rotational axis in a first direction. A second fan is coupled to the at least one motor and rotates about a second rotational axis in a second direction, which is opposite the first direction. A baffle wall is disposed proximate to the first fan and the second fan, forming a planar surface arranged substantially perpendicular to the rotational axes of the fans. A plurality of first ventilation openings is formed in the baffle wall aligned with the first fan. The first openings successively increase in proportion radially outward from the first rotational axis and in the first direction. A plurality of second ventilation openings is formed in the baffle wall aligned with the second fan. The second openings successively increase in proportion radially outward from the second rotational axis in the second direction.

According to another aspect of the present disclosure, a method for circulating oven air comprises displacing first air with a first fan rotating about a first rotational axis in a first direction. The first air is communicated through first openings formed in the baffle wall. The method further includes displacing second air with a second fan rotating about a second rotational axis in a second direction. The second direction is counterclockwise, while the first direction is clockwise. The second air is communicated through second openings formed in the baffle wall.

According to yet another aspect of the present disclosure, a baffle wall for an oven air circulation apparatus comprises a first fan coupled to at least one motor that rotates about a first rotational axis in a first direction. A second fan is coupled to the at least one motor and rotates about a second rotational axis in a second direction that is opposite to the first direction. The baffle wall comprises a planar surface arranged substantially perpendicular to the rotational axes of the fans. A plurality of first openings are formed in the planar surface and aligned with the first fan. The first openings successively increase in proportion radially outward from the first rotational axis and in the first direction. A plurality of second openings are formed in the baffle wall and aligned with the second fan. The second openings successively increase in proportion radially outward from the second rotational axis along the second direction.

These and other features, advantages, and objects of the present disclosure will be further understood and appreciated by those skilled in the art by reference to the following specification, claims, and appended drawings.

Figure 1:
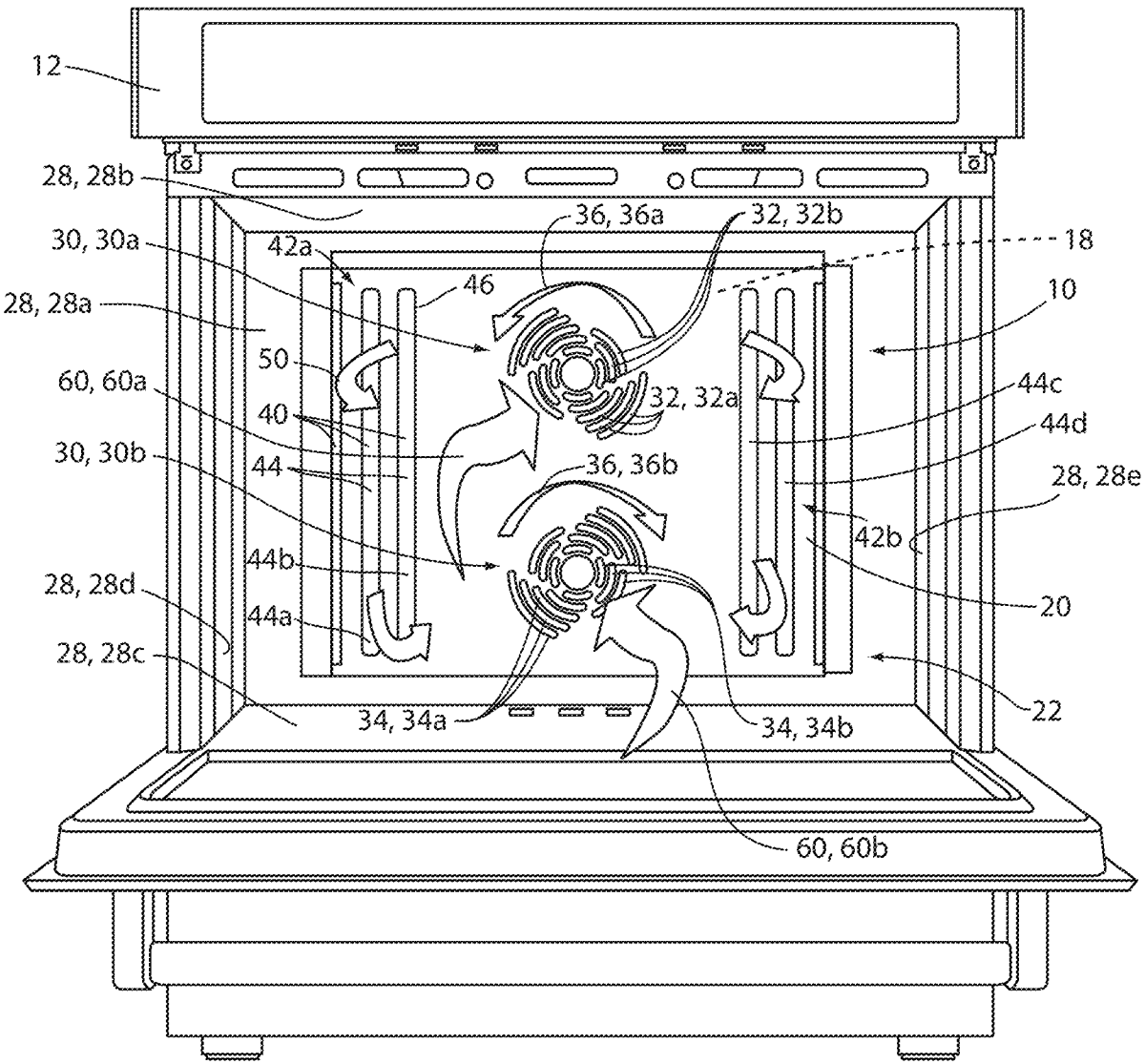
FIG. 1 is a front view of a convection oven with an oven door in an open configuration demonstrating an oven cavity.

The components in the figures are not necessarily to scale, emphasis instead being placed upon illustrating the principles described herein.

DETAILED DESCRIPTION

The present illustrated embodiments reside primarily in combinations of method steps and apparatus components related to a cooking appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Figure 2:
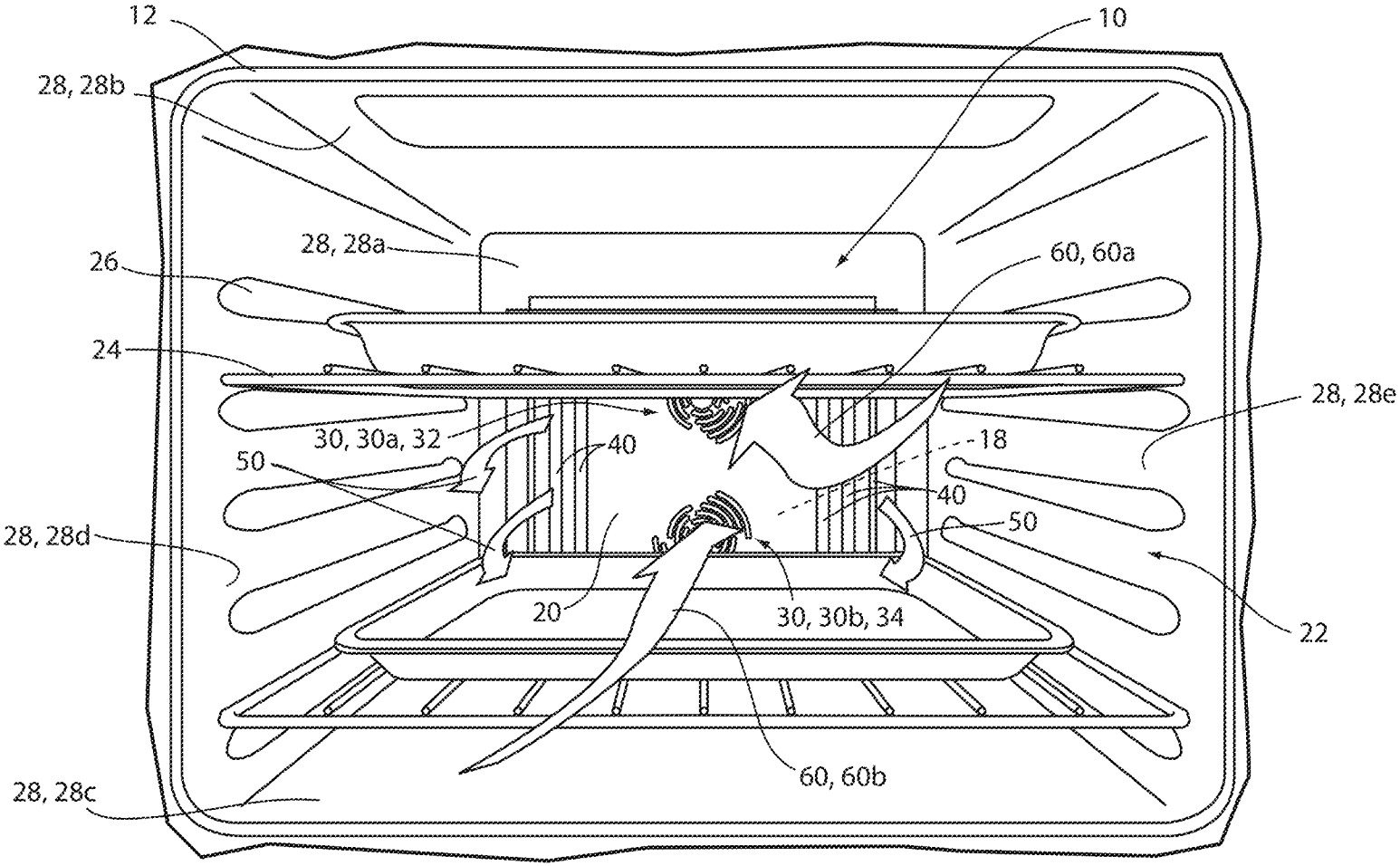
FIG. 2 is a front view of an oven cavity demonstrating an air circulation path controlled by an air circulation apparatus.
Figure 3:
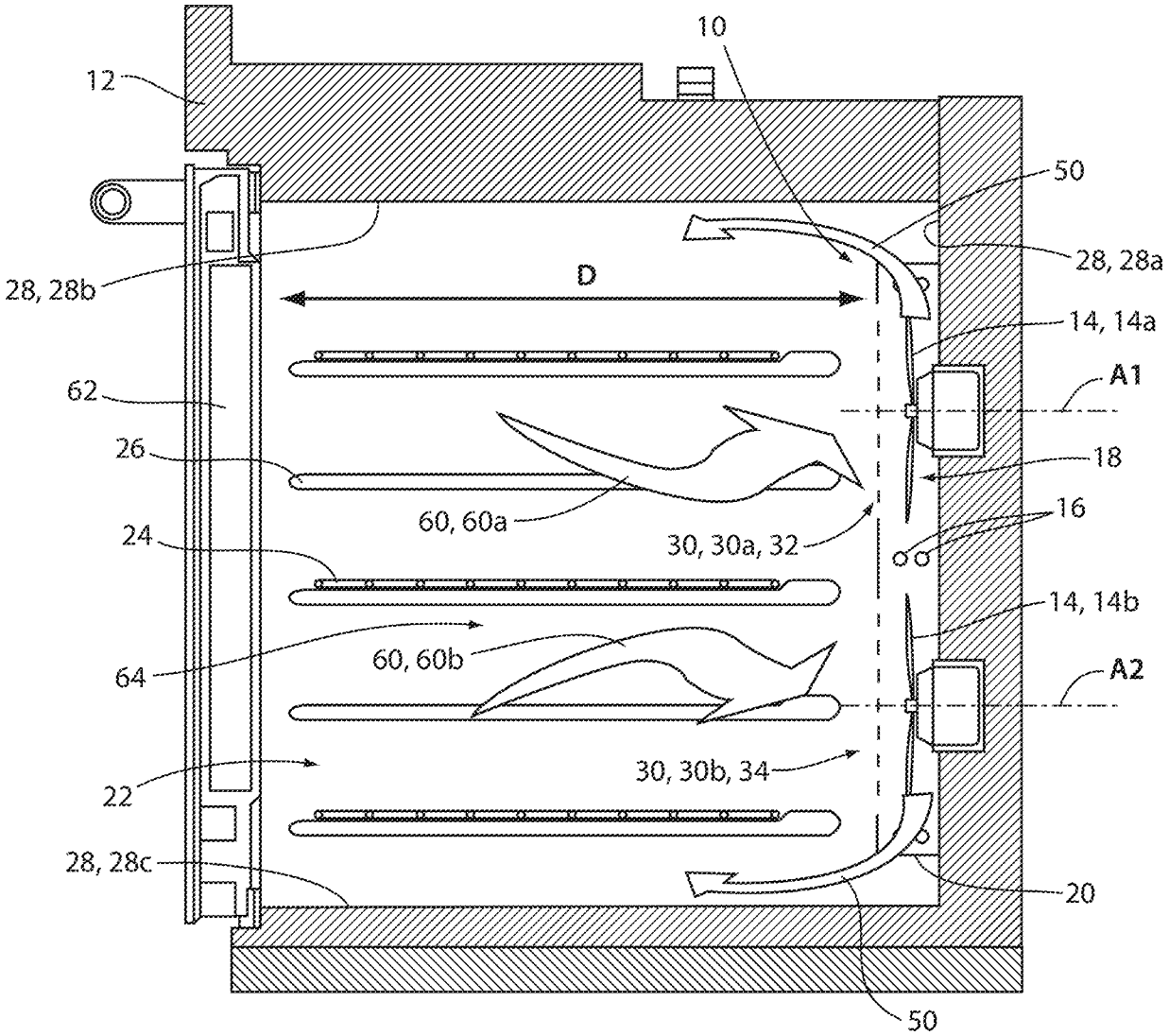
FIG. 3 is a side view of an oven cavity demonstrating an air circulation path controlled by an air circulation apparatus.

Referring to FIGS. 1-3, the disclosure generally provides for an air circulation apparatus 10 or assembly for a cooking appliance 12. In general, the air circulation apparatus 10 comprises a plurality of circulation fans 14 and at least one heating element 16 disposed in a heating chamber 18, as best depicted in FIG. 2. A baffle wall 20 separates the heating chamber 18 from an oven cavity 22, which may include a plurality of shelves 24 adjustably positioned along support structures 26 connected to or formed from oven walls 28. In operation, air is circulated between the oven cavity 22 and the heating chamber 18 by the circulation fans 14 to improve the heat distribution within the oven cavity 22. The disclosure provides an improved operation of the circulation apparatus 10 based primarily on a complementary operation of the fans 14 in coordination with an improved configuration for a plurality of circulation inlet openings 30 or circulation passages formed in the baffle wall 20.

As shown, the baffle wall 20 is in connection with a rear oven wall 28*a* and extends outward into the oven cavity 22 to form the heating chamber 18. More specifically, the baffle wall 20 forms a perimeter of the heating chamber that extends into the oven cavity 22 along a ceiling 28*b*, a floor 28*c*, and opposing side walls 28*d*, 28*e*. In this configuration, the baffle wall 20 forms the heating chamber 18 between the rear oven wall 28*a* and the oven cavity 22, which houses the circulation fans 14 and the at least one heating element 16. In operation, air is displaced by the fans 14, which forces air within the oven cavity 22 to enter the heating chamber 18 via the plurality of inlets 30 and be expelled from the heating chamber 18 via discharge openings 40. As discussed throughout the disclosure in further detail, the inlets 30 may include a first inlet 30*a* comprising a first plurality of openings 32 (e.g., first openings) associated with a first fan 14*a* that rotates in a first direction 36*a* about a first rotational axis A1. Additionally, the inlets 30 may include a second inlet 30*b* comprising a second plurality of openings 34 associated with a second fan 14*b* that rotates in a second direction 36*b* about a second rotational axis A2. The following detailed description provides for specific features and operating characteristics of the air circulation apparatus 10.

Figure 4:
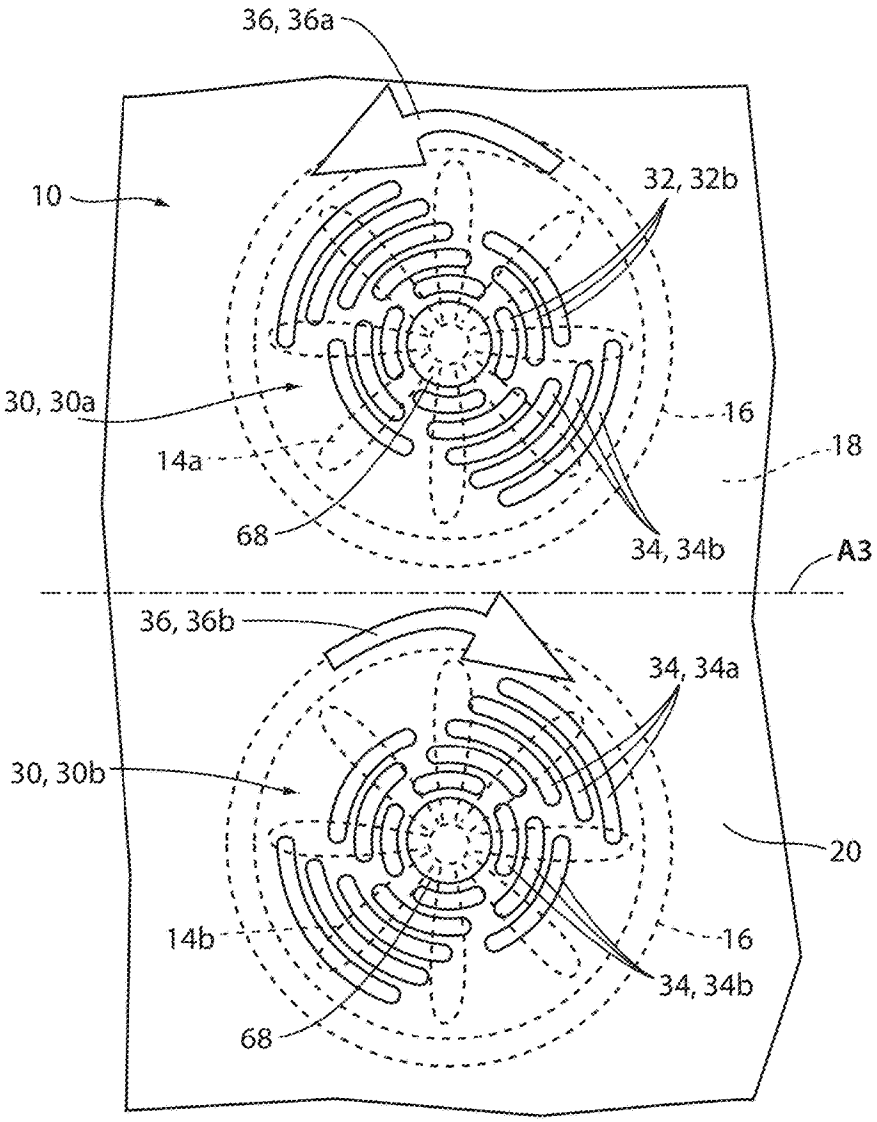
FIG. 4 is a detailed view of a baffle wall for an air circulation apparatus.
Figure 5:
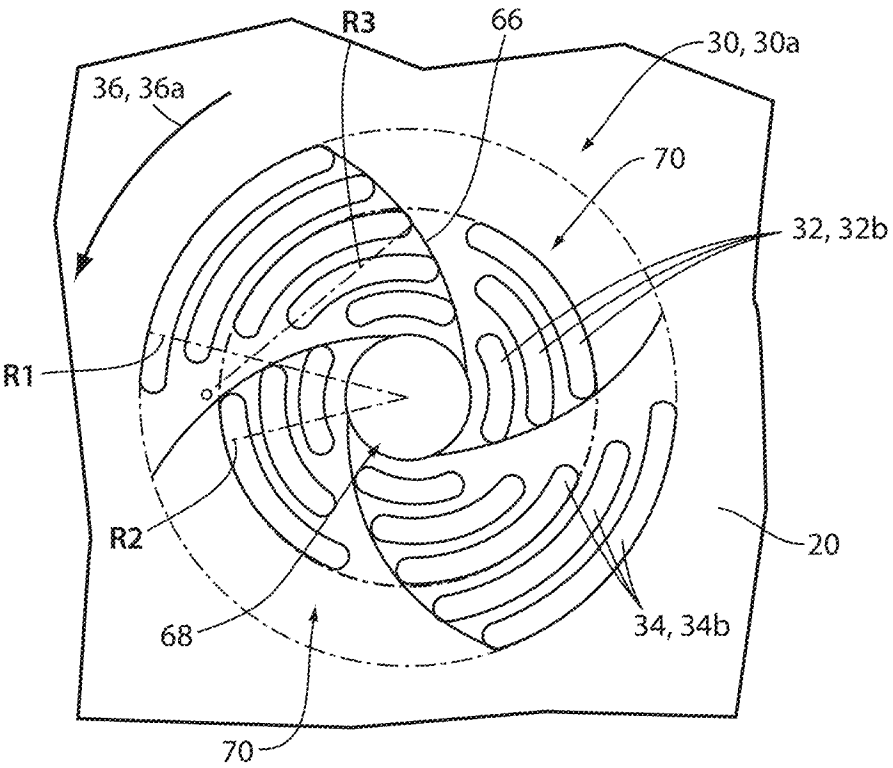
FIG. 5 is a detailed view of an air inlet for an air circulation apparatus.

As further discussed in reference to FIGS. 4 and 5, each of the inlets 30*a* and 30*b* and the corresponding openings 32 and 34 may be referred to as groups 32*a*, 32*b*, 34*a*, 34*b* having geometrically-related functional characteristics that improve the circulation of the airflow between the oven cavity 22 and the heating chamber 18. For example, each of the inlets 30*a* and 30*b* may include a first group 32*a*, 34*a* of concentrically successive openings that extend radially outward from the rotational axis A1, A2 of the corresponding fan 14*a*, 14*b* with which the inlets 30*a*, 30*b* are aligned. Additionally, each of the inlets 30*a* and 30*b* may include a first group 32*a*, 34*a* of concentrically successive openings that extend radially outward from the rotational axis A1, A2 of the corresponding fan 14*a*, 14*b* with which the inlets 30*a*, 30*b* are aligned. In addition to the related groups 32*a*, 32*b*, 34*a*, 34*b*; the inlets 30*a*, 30*b* may be mirrored about a lateral axis A3 that extends centrally along a vertical extent of the baffle wall 20. In this configuration, the openings 32, 34 are formed providing a vertical symmetry between the first inlet 30*a* and the second inlet 30*b*. When combined with the rotational configuration of the first fan 14*a* in the first direction 36*a* and the second fan 14 in the second direction 36*b*, the air circulation apparatus 10 provides for improved circulation and heat distribution within the oven cavity 22 as discussed in reference to FIGS. 6 and 7.

Referring now to FIG. 1, the circulation of the heated air within the oven cavity 22 may be controlled via the displaced air drawn into the heating chamber 18 through the inlets 30 and retuned as expelled air 50 back into the oven cavity 22 via the discharge openings 40. The discharge openings 40 extend vertically along opposing side portions 42 of the baffle wall 20. In some implementations, the discharge openings 40 may include a plurality angled passages 44 that may be formed from the baffle wall 20 as elongated channels. The elongated channels may be formed by stamping and bending the angled passages 44 into the heating chamber 18 along a pierced edge 46 extending through a thickness of the baffle wall 20. In this way, the baffle wall 20 may be efficiently manufactured or from a single sheet of material or multiple fused, welded, or otherwise assembled temperature resistant, rigid structural materials.

In various implementations, the discharge openings 40 may include a first angled passage 44*a* and a second angled passage 44*b* formed proximate to an edge of the baffle wall 20 on a first side portion 42*a*. The first and second angled passages 44*a*, 44*b* may be angled outward toward a first side oven wall 28*d*. The discharge openings 40 may further include a third angled passage 44*c* and a fourth angled passage 44*d* formed proximate to an edge of the baffle wall 20 on a second side portion 42*b*. The third and fourth angled passages 44*c*, 44*d* may be angled outward toward a second side oven wall 28*e*. In this configuration, expelled air 50 output from the heating chamber 18 may be supplied into the oven cavity 22 along an angle extending outward from a central portion of the baffle wall 20 outward into the oven cavity 22 and toward the opposing side walls 28*d*, 28*e*. As later discussed in reference to FIGS. 2-5, the outward-directed flow of the expelled air 50 may assist in the even heat distribution throughout the oven cavity 22, particularly when implemented with combined central inlet air 60 drawn through the inlet openings 30.

Referring now to FIGS. 2 and 3, an exemplary implementation of the air circulation apparatus 10 is demonstrated in the oven cavity 22. As shown, the expelled air 50 is demonstrated as being output through the discharge openings 40 extending along the opposing side portions 42 of the baffle wall 20. Additionally, the inlet air 60 is demonstrated as first inlet air 60*a* associated with the first fan 14*a* and second inlet air 60*b* associated with the second circulation fan 14*b*. The expelled air 50 generally is forced outward through the discharge openings 40 in a direction extending from the rear oven wall 28*a* toward an oven door 62. Additionally, the first inlet air 60*a* and the second inlet air 60*b* are shown drawn from within a central portion 64 of the oven cavity 22 and into the corresponding first air inlet 30*a* and second air inlet 30*b*. As further demonstrated in the simulated circulation results discussed in reference to FIG. 7, the primary benefit of the baffle wall 20 implemented in combination with the fans 14 is that the inlet air 60 is effectively drawn across a depth D of the oven cavity 22 to provide for improved heat distribution throughout. The extended reach or suction of the inlet air 60 drawn through the oven cavity 22 via the air circulation apparatus 10 is provided by the combined operation of the direction of rotation 36 of each of the fans 14 in combination with the first openings 32 and second openings 34 of the air inlets 30*a*, 30*b*.

Referring now to FIGS. 4 and 5, detailed view of the air inlets 30 formed through the baffle wall 20 are discussed in further detail. As previously discussed, the first air inlet 30*a* may include a plurality of first ventilation openings 32. The first openings 32 are radially distributed about a first axis A1 of the first fan 14*a*. The first openings 32 include a first group 32*a* and a second group 32*b*. Each of the first group 32*a* and the second group 32*b* form elongated apertures that extend perpendicular to a radial axis extending through the first rotational axis A1. Additionally, each of the successive first openings 32 of the first group 32*a* and the second group 32*b* may successively increase in proportion outward from the first rotational axis A1. Finally, the first openings 32 of the first group 32*a* and the second group 32*b* are radially distributed along a curved profile 66 that extends outward in the first direction of rotation 36*a* of the first fan 14*a*.

While the first openings 32, including the first group 32*a* and the second group 32*b*, include various similarities as previously discussed, the proportions and corresponding geometries also differ in beneficial ways that improve the draw of the inlet air 60 into the heating chamber 18. For example, the first group 32*a* of the first openings 32 extends outward from a central opening 68 aligned with the first rotational axis A1 of the first fan 14*a* to a first radius R1. The second group 32*b* of the first openings 32 similarly extends successively outward from the central opening 68 but to a second radius R2. The first radius R1 is greater than the second radius R2, such that the first group 32*a* of the first openings 32 extends further outward from the central opening 68 and also provides for a larger opening area than the second group 32*b*. Stated in the alternative, the shorter second radius R2 creates a concentrically blocked perimeter portion 70 extending beyond the second radius R2 to the corresponding radial extent of the first radius R1. As shown in FIG. 4, each of the air inlets 30 include the blocked concentric perimeter portion 70 mirrored across the lateral axis A3 of the baffle wall 20. When combined with the directions of rotation 36 of each of the circulation fans 14, the opposing blocked concentric perimeter portions 70 of the first inlet 30*a* and the second inlet 30*b* provide for a complementary dual vortex suction airflow drawn into each of the respective circulation fans 14*a*, 14*b* through the oven cavity 22.

As discussed specifically in reference to the first group 32*a* and the second group 32*b* forming the first openings 32, the second openings 34 associated with the second circulation fan 14*b* include similar features as previously discussed. For example, the first group 34*a* includes similar concentrically successive openings extending out to the first radius R1. The second group 34*b* includes concentrically successive openings extending outward from the second rotational axis A2 to the second radius R2. In fact, each of the features of the first openings 32 forming the first inlet 30*a* are similarly incorporated in the second openings 34 of the second inlet 30*b* mirrored across the lateral axis A3 of the baffle wall 20.

The elongated apertures that extend perpendicular to each of the radial axes extending outward from the rotational axis A1, A2 are radially staggered along the curved profile 66. The curved profile 66 may extend along a third radius R3, generally represented in FIG. 5. The third radius R3 may be approximately equal to the first radius R1. Each of the first radius R1 and the third radius R3 may be greater than the second radius R2. In this configuration, the third radius R3 of the curved profile 66 may provide for the radially distributed alignment of each of the openings 32, 34 forming the air inlets 30 in the rotational direction 36 of each of the corresponding circulation fans 14. As previously discussed, this arrangement may further improve the effective suction of the first inlet air 60*a* and the second inlet air 60*b* by each of the circulation fans 14 to improve the heat distribution within the oven cavity 22. A described herein, the terms "approximate" and "substantially" may provide for variations in the alignment, proportions, and/or dimensions of the elements described herein. For example, an approximate or substantially similar relationship may be used to described values that are within about 10% of each other, such as within about 5% of each other, or within about 2% of each other.

Figure 6:
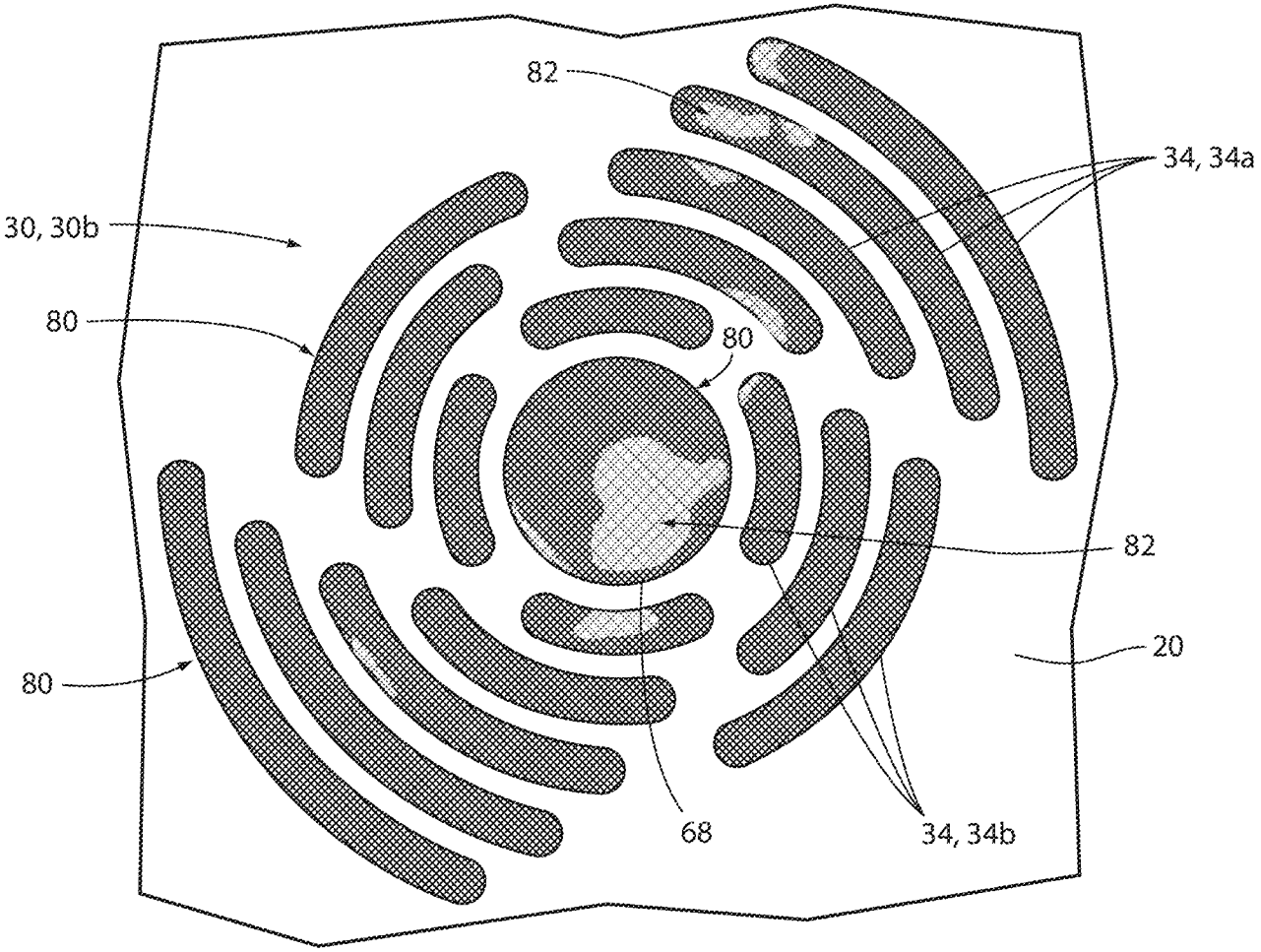
FIG. 6 is a graphic representation of an air inlet for an air circulation apparatus demonstrating a relative airflow density.

Referring now to FIG. 6, a graphic representation of an air inlet 30 for the air circulation apparatus 10 is shown demonstrating a relative airflow density. As shown, the black regions 80 of the openings 34 correspond to regions of peak airflow, while the regions with lighter shading, for example, gray regions 82, demonstrate portions of the openings 34 where the airflow decreases from the peak flow rate. As demonstrated, the relative airflow density is shown in reference to the second inlet 30*b*. However, due to the similar and complementary geometry between the inlets 30 and the opposing rotation of the corresponding fans 14, each of the inlets 30 were tested to have similar distribution and performance to the airflow density demonstrated in in FIG. 6. As exemplified, nearly all of the space formed through the baffle wall 20 by the openings 32, 34 provides the peak airflow or black regions 80 shaded in black crosshatching. As further discussed in reference to FIG. 7, the even distribution of the airflow across the openings 32, 34 enables the air circulation apparatus 10 to provide for effective suction the extends through the central portion 64 of the oven cavity 22. Finally, though the specific flow rate of the air circulated by the air circulation apparatus 10 is not detailed in the test results shown in FIGS. 6 and 7, it shall be understood that even distribution of the airflow density is applicable to various flowrates attributed to the operation of the fans 14.

Figure 7:
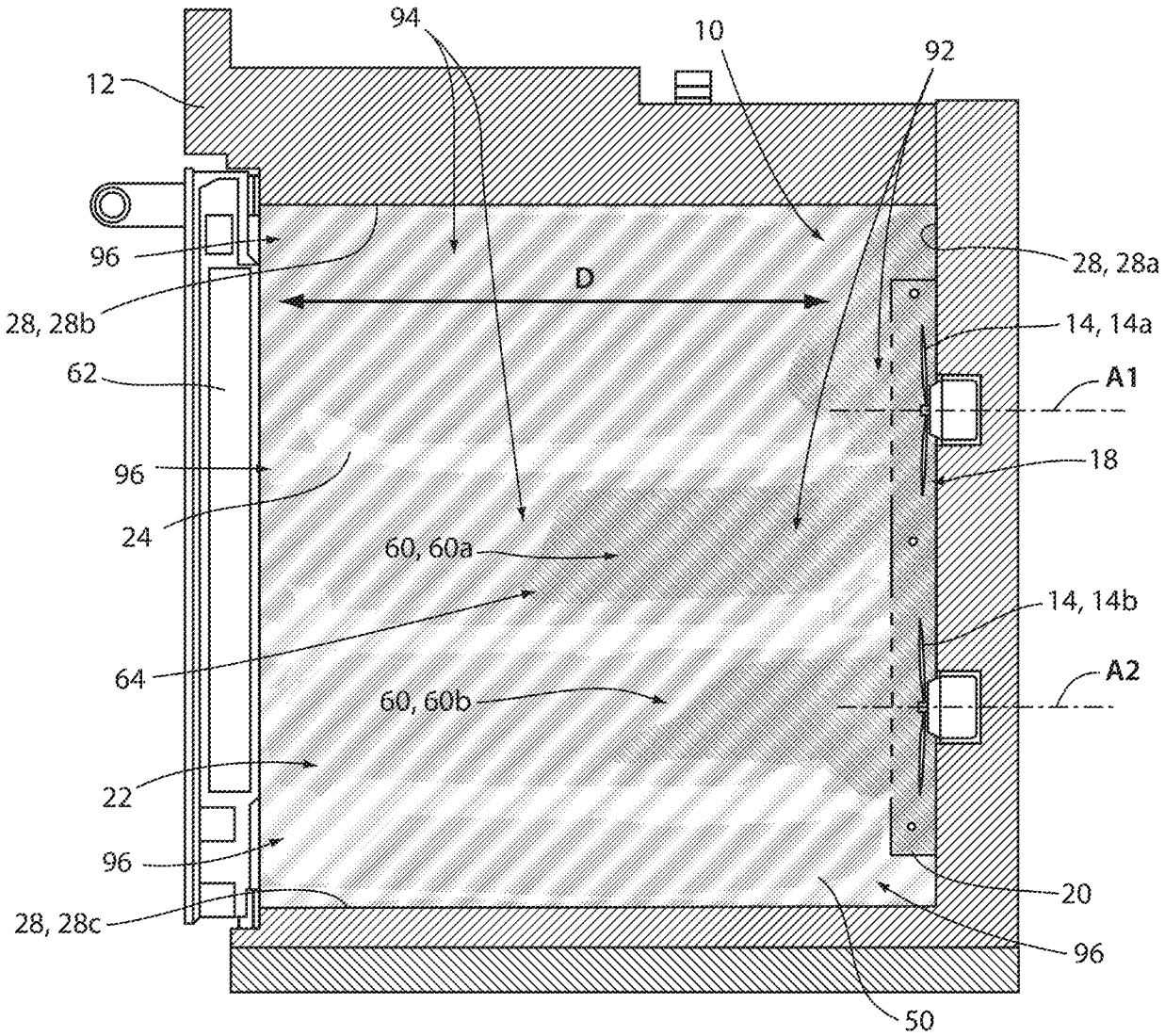
FIG. 7 shows a combination of a side view of an oven cavity with simulated convection airflow data superimposed in accordance with the disclosure.

Referring now to FIG. 7, a combination of a side view of the oven cavity 22 is shown with simulated convection airflow data superimposed. Similar to FIG. 6, the black regions 92 and gray regions 94 correspond to areas where the air is effectively circulated within the oven cavity 22. Additionally, light gray or white regions 96 correspond to portions where the airflow is interrupted or occluded. In general, the black regions 92 and gray regions 94 extend consistently from the rear oven wall 28*a* to the oven door 62. Accordingly the air circulation apparatus 10 is demonstrated to provide consistent circulation from the heating chamber 18 to the furthest extents of the oven cavity 22 proximate to the oven door 62. The airflow shown provides for consistent temperature distribution throughout the oven cavity 22.

As shown, many of the light gray or white regions 96 correspond to oven racks or shelves 24 that may occlude the airflow provided by the air circulation apparatus 10. Similarly, perimeter portions or corners of the cooking cavity demonstrate similar light gray or white regions 96 where airflow is not effectively circulated. Though these areas may appear to demonstrate limitations of the disclosed apparatus 10, these sections are not occupied by food loads when cooking. Accordingly, the regions of limited airflow represented by the light gray or white regions 96 are effectively limited by the disclosed apparatus 10 to regions that do not significantly affect the cooking performance of the oven or cooking appliance 12. Accordingly, the disclosure provides for an improved air circulation apparatus that provides for consistent heating and air circulation throughout the oven cavity 22.

According to one aspect of the present disclosure, an oven air circulation apparatus comprises a first fan coupled to at least one motor that rotates about a first rotational axis in a first direction. A second fan is coupled to the at least one motor and rotates about a second rotational axis in a second direction, which is opposite the first direction. A baffle wall is disposed proximate to the first fan and the second fan, forming a planar surface arranged substantially perpendicular to the rotational axes of the fans. A plurality of first ventilation openings is formed in the baffle wall aligned with the first fan. The first openings successively increase in proportion radially outward from the first rotational axis and in the first direction. A plurality of second ventilation openings is formed in the baffle wall aligned with the second fan. The second openings successively increase in proportion radially outward from the second rotational axis in the second direction.

According to another aspect, each of the openings is radially staggered about the rotational axes.

According to yet another aspect, the first openings are radially staggered in the first direction about the first rotational axis.

According to another aspect, the second openings are radially staggered in the second direction about the second rotational axis.

According to yet another aspect, each of the openings forms an elongated aperture extending perpendicular to radial axes extending outward from the rotational axes.

According to another aspect, an elongated dimension of each of the elongated apertures extends concentrically about the rotational axes.

According to yet another aspect, the first openings comprise a first radial group and a second radial group radially offset about the first rotational axis.

According to another aspect, the first radial group of the first openings successively extend outward from the first rotational axis to a first radius.

According to yet another aspect, the second radial group of the first openings successively extend outward from the first rotational axis to a second radius, wherein the first radius is greater than the second radius.

According to still yet another aspect, the first radial group forms a first ventilation area and the second radial group forms a second ventilation area, wherein the first ventilation area is greater than the second ventilation area.

According to another aspect of the present disclosure, a method for circulating oven air comprises displacing first air with a first fan rotating about a first rotational axis in a first direction. The first air is communicated through first openings formed in the baffle wall. The method further includes displacing second air with a second fan rotating about a second rotational axis in a second direction. The second direction is counterclockwise, while the first direction is clockwise. The second air is communicated through second openings formed in the baffle wall.

According to another aspect, a first ventilation area of the first openings through which the first air is communicated successively increases in proportion radially outward from the first rotational axis and in the first direction.

According to yet another aspect, a second ventilation area of the second openings through which the second air is communicated successively increases in proportion radially outward from the second rotational axis and in the second direction.

According to another aspect, the method comprises communicating the first air and the second air to a common chamber formed by the baffle wall, and heating combined air formed by the first air and the second air in the common chamber.

According to yet another aspect, the method comprises expelling the combined air from the common chamber via a plurality of elongated ducts extending vertically along the baffle on opposing sides of the first fan and the second fan.

According to yet another aspect of the present disclosure, a baffle wall for an oven air circulation apparatus comprises a first fan coupled to at least one motor that rotates about a first rotational axis in a first direction. A second fan is coupled to the at least one motor and rotates about a second rotational axis in a second direction that is opposite to the first direction. The baffle wall comprises a surface arranged substantially perpendicular to the rotational axes of the fans. A plurality of first openings are formed in the surface through the baffle wall and aligned with the first fan. The first openings successively increase in proportion radially outward from the first rotational axis and in the first direction. A plurality of second openings are formed in the surface through the baffle wall and aligned with the second fan. The second openings successively increase in proportion radially outward from the second rotational axis along the second direction.

According to another aspect, the baffle wall forms a heating chamber housing at least one heater device, wherein first air communicated by the first fan through the first openings and second air communicated by the second fan through the second openings is communicated into the heating chamber.

According to yet another aspect, a plurality of elongated ducts formed in the baffle wall on opposing sides of the first openings and the second openings.

According to another aspect, the first openings are arc-shaped openings successively formed in the baffle wall concentrically outward from the first rotational axis and radially offset in the first direction.

According to yet another aspect, the second openings are arc-shaped openings successively formed in the baffle wall concentrically outward from the second rotational axis and radially offset in the second direction.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An oven air circulation apparatus comprising:

a first fan coupled to at least one motor that rotates about a first rotational axis in a first direction;

a second fan coupled to the at least one motor that rotates about a second rotational axis in a second direction, opposite the first direction;

a baffle wall disposed proximate to the first fan and the second fan forming a planar surface arranged substantially perpendicular to the rotational axes of the fans;

a plurality of first openings formed in the baffle wall aligned with the first fan, wherein the first openings successively increase in proportion radially outward from the first rotational axis and in the first direction; and a plurality of second openings formed in the baffle wall aligned with the second fan, wherein the second openings successively increase in proportion radially outward from the second rotational axis along the second direction wherein each of the openings is radially staggered about the rotational axis.

2. The circulation apparatus according to claim 1, wherein the first openings are radially staggered in the first direction about the first rotational axis.

3. The circulation apparatus according to claim 1, wherein the second openings are radially staggered in the second direction about the second rotational axis.

4. The circulation apparatus according to claim 1, wherein each of the openings forms an elongated aperture extending perpendicular to radial axes extending outward from the rotational axes.

5. The circulation apparatus according to claim 4, wherein an elongated dimension of each of the elongated apertures extends concentrically about the rotational axes.

6. The circulation apparatus according to claim 1, wherein the first openings comprise a first radial group and a second radial group radially offset about the first rotational axis.

7. The circulation apparatus according to claim 6, wherein the first radial group of the first openings successively extend outward from the first rotational axis to a first radius.

8. The circulation apparatus according to claim 7, wherein the second radial group of the first openings successively extend outward from the first rotational axis to a second radius, wherein the first radius is greater than the second radius.

9. The circulation apparatus according to claim 6, wherein the first radial group forms a first ventilation area and the second radial group forms a second ventilation area, wherein the first ventilation area is greater than the second ventilation area.

10. A baffle wall for an oven air circulation apparatus comprising a first fan coupled to at least one motor that rotates about a first rotational axis in a first direction, a second fan coupled to the at least one motor that rotates about a second rotational axis in a second direction, opposite the first direction, wherein the baffle wall comprises:

a surface arranged substantially perpendicular to the rotational axes of the fans;

a plurality of first openings formed in the surface through the baffle wall and aligned with the first fan, wherein the first openings successively increase in proportion radially outward from the first rotational axis and in the first direction; and a plurality of second openings formed in the surface through the baffle wall aligned with the second fan, wherein the second openings successively increase in proportion radially outward from the second rotational axis along the second direction where the first openings are arc-shaped openings successively formed in the baffle wall concentrically outward from the first rotational axis and radially offset in the first direction.

11. The baffle wall according to claim 10, wherein the baffle wall forms a heating chamber housing at least one heater device, wherein first air communicated by the first fan through the first openings and second air communicated by the second fan through the second openings is communicated into the heating chamber.

12. The baffle wall according to claim 10, further comprising a plurality of elongated ducts formed in the baffle wall on opposing sides of the first openings and the second openings.

13. The baffle wall according to claim 10, where the second openings are arc-shaped openings successively formed in the baffle wall concentrically outward from the second rotational axis and radially offset in the second direction.

* * * * *